US006515628B2

(12) United States Patent
Roberts

(10) Patent No.: US 6,515,628 B2
(45) Date of Patent: Feb. 4, 2003

(54) DUAL POLARIZATION PATCH ANTENNA

(75) Inventor: Arthur George Roberts, Wellington (NZ)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/918,374

(22) Filed: Jul. 30, 2001

(65) Prior Publication Data

US 2002/0014995 A1 Feb. 7, 2002

(30) Foreign Application Priority Data

Jul. 31, 2000 (NZ) ..... 506062

(51) Int. Cl.[7] ..... H01Q 1/38

(52) U.S. Cl. ..... 343/700 MS; 343/730; 343/731

(58) Field of Search ..... 343/700 MS, 701, 343/731, 743, 830, 831, 852; H01Q 1/38

(56) References Cited

U.S. PATENT DOCUMENTS

| | | | | | |
|---|---|---|---|---|---|
| 4,364,050 | A | * | 12/1982 | Lopez | 343/700 MS |
| 5,382,959 | A | * | 1/1995 | Pett et al. | 343/700 MS |
| 5,406,292 | A | * | 4/1995 | Schnetzer et al. | 343/700 MS |
| 5,432,487 | A | * | 7/1995 | Dydyk | 333/161 |
| 5,764,195 | A | * | 6/1998 | Colclough et al. | 343/797 |
| 5,767,814 | A | * | 6/1998 | Conroy et al. | 343/774 |
| 6,147,648 | A | * | 11/2000 | Granholm et al. | 343/700 MS |
| 6,229,484 | B1 | * | 5/2001 | Sagisaka | 343/700 MS |

OTHER PUBLICATIONS

Chiba et al., 1982, IEEE AP–S Int. Symposium Antennas and Propagat. Digest, pp. 285–288, "Suppression of higher modes and cross polarized component for microstrip antennas".

* cited by examiner

*Primary Examiner*—Don Wong
*Assistant Examiner*—Trinh Vo Dinh
(74) *Attorney, Agent, or Firm*—Merchant & Gould P.C.

(57) ABSTRACT

A dual polarization patch antenna comprising a patch, first and second pairs of orthogonally disposed probes feeding said patch, and a first feed network for feeding said first pair of probes from a first feed point. The first feed network comprises a first feed path from said first feed point to a first probe, a second feed path from said first feed point to a second probe, said second feed path being of a different electrical length to said first feed path such as to cause cancellation of signals from said first and second probes at said second pair of probes, and a first frequency dependent element provided in said first feed path for maintaining the desired cancellation over a desired frequency range. A second feed network for feeding said second pair of probes from a second feed point comprises a third feed path from said second feed point to a third probe, a fourth feed path from said second feed point to a fourth probe, said fourth path being of a different electrical length to the third feed path such as to cause cancellation of signals from the third and fourth probes at said first pair of probes, and a second frequency dependent element provided in said third feed path for maintaining the desired cancellation over a desired frequency range.

8 Claims, 4 Drawing Sheets

DUAL POLARIZATION PATCH ANTENNA

BACKGROUND OF THE INVENTION

The present invention relates to a dual polarisation patch antenna having good isolation between polarisations over a broad bandwidth.

Referring to FIG. 1 a dual polarised antenna of known construction is shown (see for example CHIBA, T., SUZUKI, Y., and MIYANO, N.: "Suppression of higher modes and cross polarised component for microstrip antennas". IEEE AP-S Int. Symposium Antennas and Propagat. Digest, 1982, pp.285–288. The antenna consists of a patch 1 (in dashed outline) fed by probes 2, 3, 4 and 5. Signals of a first polarisation are conveyed between feed point 6 via a first feed path 7 and a second feed path 8. Second feed path 8 includes a half wavelength section 9, making feed path 8 a half wavelength longer than feed path 7. Accordingly, at the central operating frequency, signals from probes 2 and 4 are 180° out-of-phase and cancel at probes 3 and 5.

For signals of the second polarisation the feed paths 11 and 12 between feed point 10 and probes 3 and 5 correspond to those described above and so the signals from probes 3 and 5 cancel at probes 2 and 4 at the central operating frequency.

Accordingly, good isolation is achieved between polarisations at the central operating frequency. Referring to FIG. 2 the relationship between the phase of signals supplied to probes 2 and 4 via feed paths 7 and 9 is shown with respect to frequency. It will be seen that at the central operating frequency-$f_c$, the desired 180° phase separation is achieved. As shown in FIG. 3 this results in good isolation between the polarisations at the central frequency.

However, the required isolation can only be maintained over a relatively narrow frequency of operation. It would be highly desirable to provide a feed network capable of maintaining isolation greater than 30 db over a wider frequency range.

It is an object of the present invention to provide a dual polarisation patch antenna having improved isolation over a greater frequency range or to at least provide the public with a useful choice.

BRIEF SUMMARY OF THE INVENTION

According to the invention there is provided a dual polarisation patch antenna comprising:

a patch;

a first and second pair of orthogonally disposed probes feeding the patch;

a first feed network for feeding the first pair of probes from a first feed point comprising:

i) a first feed path from the first feed point to a first probe;

ii) a second feed path from the first feed point to a second probe; said second feed path being of a different electrical length to the first feed path such as to cause cancellation of signals from the first and second probes at the second pair of probes; and iii) a first frequency dependent element provided in the first feed path for maintaining the desired cancellation over a desired frequency range; and a second feed network for feeding the second pair of probes from a second feed point comprising:

i) a third feed path from the second feed point to a third probe;

ii) a fourth feed path from the second feed point to a fourth probe, said fourth path being of a different electrical length to the first third path such as to cause cancellation of signals from the third and fourth probes at the first pair of probes; and iii) a second frequency dependent element provided in the third feed path for maintaining the desired cancellation over a desired frequency range.

The frequency dependent element preferably comprises two quarter-wave separated, open half-wavelength stubs. Alternatively, the frequency dependent element may comprise a Schiffman phase shifter.

The feed paths preferably differ by a half-wavelength (at the desired central operating frequency). The feed paths may be of the same physical length. In this case, the difference in electrical length may be achieved by the insertion of a suitable dielectric material adjacent to one of the feed lines, thus reducing the propagation speed in the feed line (and hence increasing the electrical length). However preferably the feed paths are of different physical lengths.

BRIEF DESCRIPTION OF THE DRAWINGS

The invention will now be described by way of example with reference to the accompanying drawings in which.

BEST MODE FOR CARRYING OUT THE INVENTION

Figure 4:
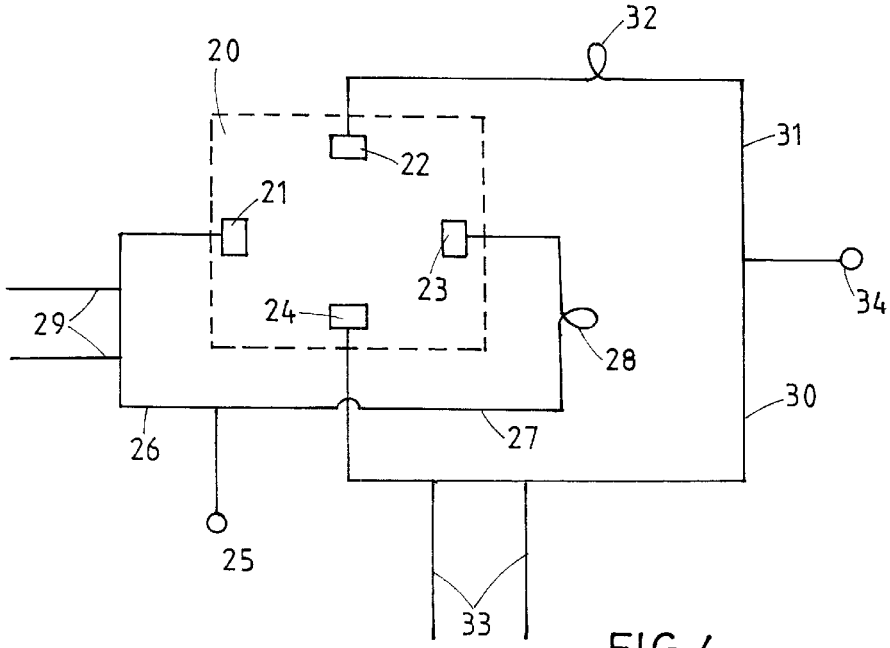
FIG. 4 shows a dual polarisation antenna including a feed network according to the invention.

Referring now to FIG. 4 a feed network for a dual polarisation patch antenna will be described to illustrate the invention. A patch 20 is fed by probes 21, 22, 23 and 24. The feed network for the first polarisation comprises a first feed path 26 from feed point 25 to probe 21 and a second feed path 27 from feed point 25 to probe 23. Feed path 27 includes a half wavelength section 28 so that signals provided to probes 21 and 23 are 180° out of phase at the central operating frequency.

Feed path 26 further includes two quarter-wave separated open half-wavelength stubs 29. These are frequency dependent elements which alter the phase of signals conveyed via feed path 26 in dependence upon frequency.

Figure 5:
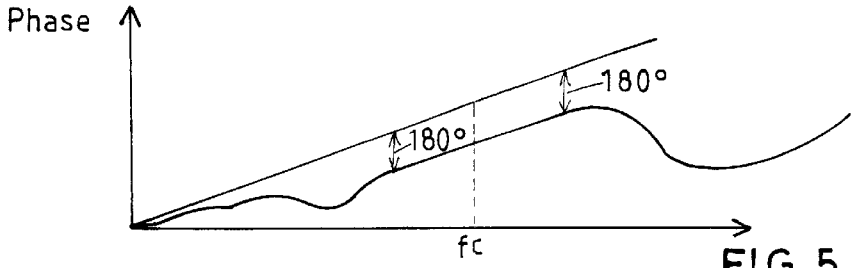
FIG. 5 shows the phase relationship between signals conveyed via a first feed path of one feed network compared to the second feed path of the feed network over a range of frequencies.

Referring now to FIG. 5 it will be seen that the inclusion of stubs 29 in feed path 26 has changed the variation in phase of signals conveyed via feed paths 26 so that the phases of signals conveyed via feedpath 26 and 27 remain separated by approximately 180° over a reasonably wide frequency range. This results in signals from probes 21 and 23 cancelling at probes 22 and 24 over a wide frequency range, resulting in improved isolation.

Figure 1:
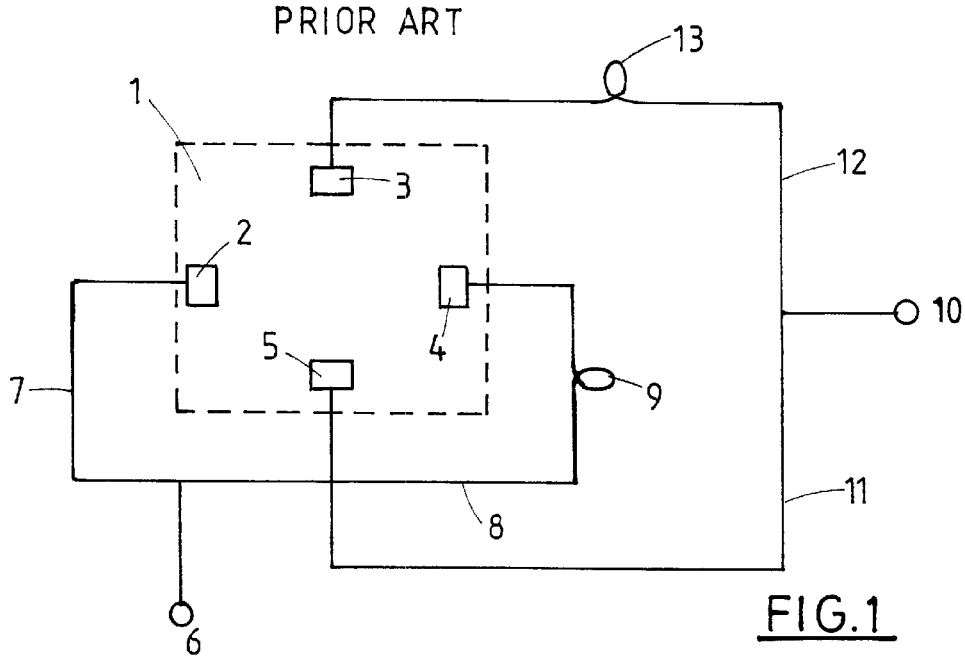
FIG. 1 shows a prior art feed arrangement for feeding a dual polarised antenna.
Figure 2:
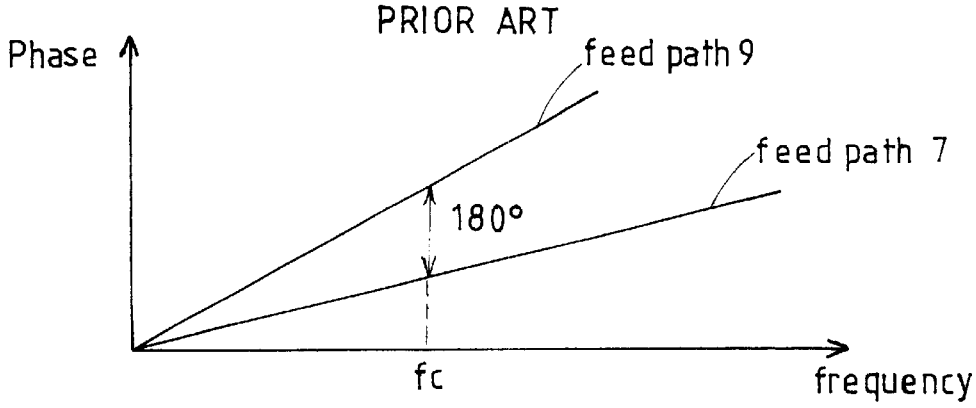
FIG. 2 shows the phase relationship of signals provided by one feed network of the antenna shown in FIG. 1.
Figure 3:
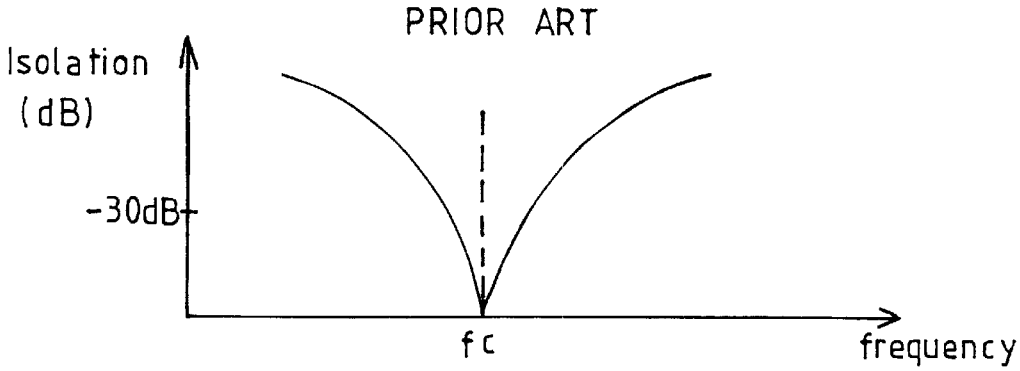
FIG. 3 shows the isolation achieved between polarisations of the antenna shown in FIG. 1.
Figure 6:
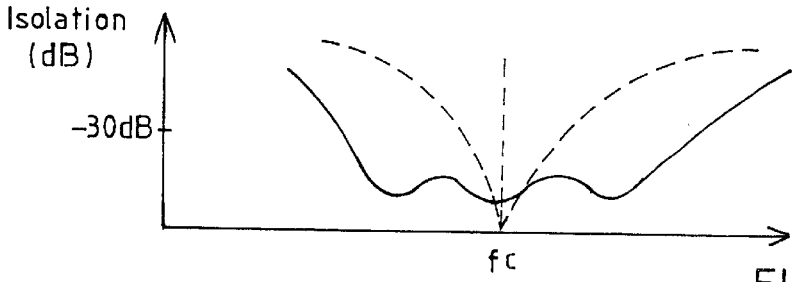
FIG. 6 shows the isolation achieved between polarisations for the feed network shown in FIG. 4.

Referring to FIG. 6 it will be seen that a much improved isolation bandwidth between polarisations is achieved for the feed network shown in FIG. 4 compared to that of the feed network shown in FIG. 1 (dashed lines). The bandwidth for which isolation is below −30 dB is over 4 times greater with stubs (FIG. 4 embodiment) than without (FIG. 1 embodiment).

It will be appreciated that the feed network comprising elements 30 to 33 operates in an analogous manner to the feed network comprising elements 26 to 29 described above.

In the embodiment shown in FIG. 4 pairs of stubs 29 and 33 are used. Two stubs are utilised to compensate for mismatching. By utilising a pair of stubs reflections from one stub may be cancelled by the other.

Figure 7:
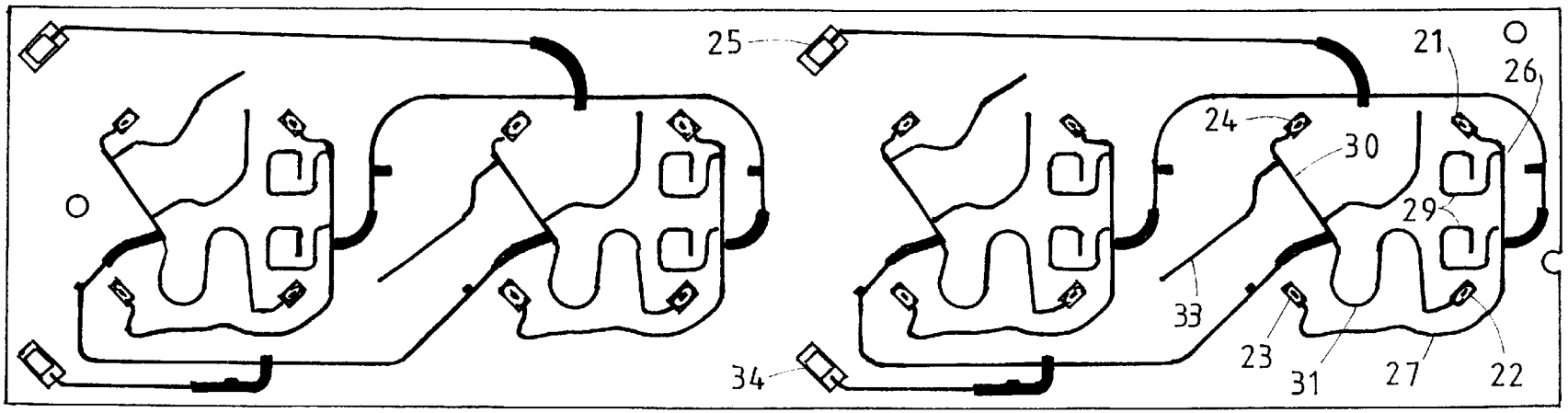
FIG. 7 shows a feed network of the type shown in FIG. 4 for feeding four patches of an array panel antenna.

Referring now to FIG. 7 a practical implementation of the feed arrangement shown in FIG. 4 in a panel antenna is shown, The corresponding numbers to those used in FIG. 4 have been applied to the corresponding integers in FIG. 7. It will be noted that the stubs 29 and 33 have a range of geometries so that they may be accommodated within the feed network layout. The components of the feed networks for the other three patches are the same and so the components have not been numbered.

Figure 8:
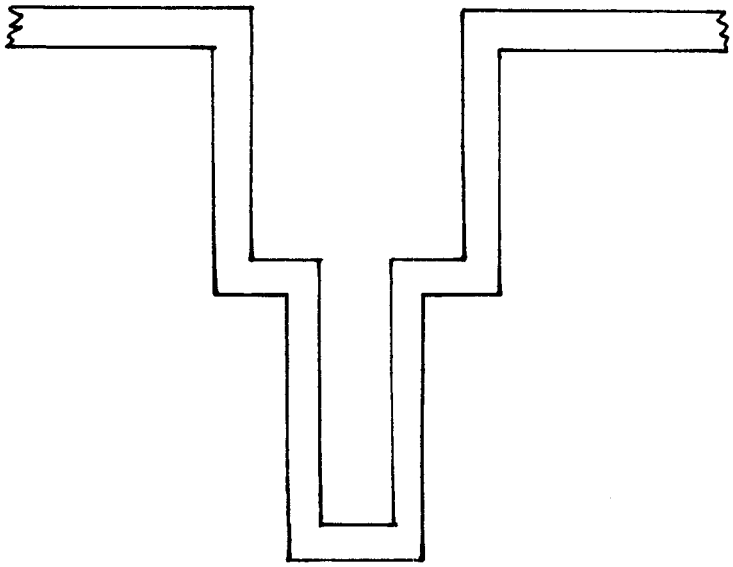
FIG. 8 shows a Schiffman phase shifter which may be substituted for the stubs shown in FIGS. 4 and 7.

Referring now to FIG. 8 a Schiffman phase shifter is shown. This is a frequency dependent phase shifter which may be substituted for the stubs 29 and 33 of FIG. 4. It will be appreciated that other suitable frequency dependent phase shifting elements may likewise be substituted as appropriate to achieve the desired isolation.

Figure 9:
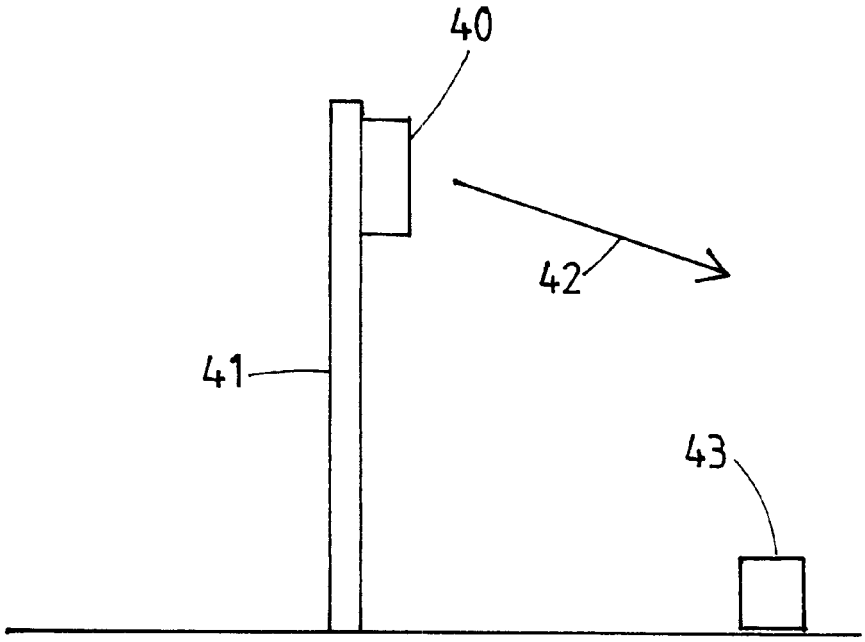
FIG. 9 shows a land-based cellular communication base station incorporating a panel antenna.

A preferred use of the antenna is shown in FIG. 9, which is a schematic illustration of a land-based cellular communication base station. A panel antenna 40 incorporating the feed network of FIG. 7 is mounted on a mast 41, and transmits/receives downlink/uplink signals via a downtilted antenna beam 42 to/from mobile hand-held communication units 43.

Where in the foregoing description reference has been made to integers or components having known equivalents then such equivalents are herein incorporated as if individually set forth.

Although this invention has been described by way of example it is to be appreciated that improvements and/or modifications may be made thereto without departing from the scope or spirit of the present invention.

What is claimed is:

1. A dual polarisation patch antenna comprising:

a patch;

a first and second pair of orthogonally disposed probes feeding said patch;

a first feed network for feeding said first pair of probes from a first feed point comprising:

a first feed path from said first feed point to a first probe;

a second feed path from said first feed point to a second probe; said second feed path being of a different electrical length to said first feed path such as to cause cancellation of signals from said first and second probes at said second pair of probes; and a first frequency dependent element provided in said first feed path for maintaining the desired cancellation over a desired frequency range; and a second feed network for feeding said second pair of probes from a second feed point comprising:

a third feed path from said second feed point to a third probe;

a fourth feed path from said second feed point to a fourth probe, said fourth path being of a different electrical length to said third feed path such as to cause cancellation of signals from the third and fourth probes at said first pair of probes; and a second frequency dependent element provided in said third feed path for maintaining the desired cancellation over a desired frequency range.

2. The antenna of claim wherein 1 said first and second frequency dependent elements each comprise two quarter-wave separated, open half-wavelength stubs.

3. The antenna of claim wherein 1 said first and second frequency dependent elements each comprise a Schiffman phase shifter.

4. The antenna of claim 1 wherein said electrical length difference between said first and second feed paths is a half-wavelength at a desired central operating frequency.

5. The antenna of claim 1 wherein said electrical length difference between said third and fourth feed paths is a half-wavelength at a desired central operating frequency.

6. The antenna of claim 1 wherein said first and second feed paths have a different physical length.

7. The antenna of claim 1 wherein said third and fourth paths have a different physical length.

8. A land-based cellular communication system including an antenna according to claim 1.

* * * * *